US005091056A

United States Patent [19]

Autio

[11] Patent Number: 5,091,056

[45] **Date of Patent: * Feb. 25, 1992**

[54] STRUCTURAL FRAME FOR SEPARATE NIPS IN A PRESS SECTION

[75] Inventor: Markku Autio, Jyväskylä , Finland

[73] Assignee: Valmet Paper Machinery Inc., Finland

[ * ] Notice: The portion of the term of this patent subsequent to Mar. 20, 2007 has been disclaimed.

[21] Appl. No.: 671,003

[22] Filed: Mar. 18, 1991

Related U.S. Application Data

[63] Continuation of Ser. No. 470,159, Jan. 15, 1990, abandoned, which is a continuation of Ser. No. 181,738, Apr. 14, 1988, abandoned.

[30] Foreign Application Priority Data

Apr. 14, 1987 [FI] Finland ..... 871560

[51] Int. Cl.[5] ..... D21F 3/02

[52] U.S. Cl. ..... 162/360.1; 162/273; 162/274

[58] Field of Search ..... 162/272, 273, 274, 358, 162/360.1

[56] References Cited

U.S. PATENT DOCUMENTS

| | | | |
|---|---|---|---|
| 4,526,655 | 7/1985 | Karvinen et al. | 162/360.1 |
| 4,608,125 | 8/1986 | Autio | 162/273 |
| 4,909,905 | 3/1990 | Ilmarinen et al. | 162/360.1 |

*Primary Examiner*—Karen M. Hastings
*Attorney, Agent, or Firm*—Steinberg & Raskin

[57] ABSTRACT

Structural frame for a press section in a paper machine in which there are two or three succeeding, separate press nips substantially dewatering a web. The nibs are each formed between two opposite press elements, such as press rolls. The web runs supported by a dewatering and/or transfer fabric through the nips. The structural frame comprises a front frame and a rear frame separate from one another, with a space open at the top being provided therebetween. This space is arranged so as to be utilized in replacement of both upper press and/or transfer fabrics and of the press rolls. At least the upper roll of the first or second nip is attached in connection with the rear part of the front frame. At least the upper roll of the second or third press nip is fitted in conjunction with a front part of the rear frame.

17 Claims, 4 Drawing Sheets

STRUCTURAL FRAME FOR SEPARATE NIPS IN A PRESS SECTION

This is a continuation of application Ser. No. 07/470,159, filed Jan. 15, 1990, which in turn is a continuation of Ser. No. 07/181,738, filed Apr. 14, 1988, both now abandoned.

BACKGROUND OF THE INVENTION

The present invention concerns a frame construction for a press section of a paper machine in which there are at least two, preferably three successive and separate press nips in a direction of running of the web from which water is removed, the press nips substantially dewatering the web and being formed between two opposite press elements such as press rolls. The web runs through these nips supported by a dewatering and/or transfer fabric.

In prior art press sections of a paper machine such as the Valmet so-called Sym-Press (TM) press section, there have been horizontal beams above the press rolls both at the service side and at the operating side of the paper machine, which connect the front frame and the rear frame of the press section permanently together. In this connection and also in the following description, the front frame means the frame part that is situated in the running direction of the web at the front side, with a pick-up suction roll of the press being fixed, e.g., to the front frame. In a corresponding manner, the rear frame means the frame part situated at the rear side of the press section, i.e. closer to the drying section.

From the Valmet Finnish Patent Applications Nos. 823187, 842114, and 842115, paper machine press sections provided with separate press nips are previously known in which there are two or three succeeding, separate press nips in a running direction of the web substantially dewatering the web, these nips being formed between two press rolls. The web runs through the nips between two fabrics. At least in the first one of the nips, the dewatering takes place through both faces of the web as the nips are formed between two hollow-faced press rolls or between a hollow-faced roll and a smooth-faced roll. In the press section, the first upper or lower fabric acts as a pick-up fabric, onto which the web is transferred from the forming wire.

According to the Valmet Finnish Patent Application No. 823187, it is considered an important feature in the press section described therein, that the press section includes two upper fabrics and two lower fabrics. The first fabrics in the running direction of the web are press fabrics that receive water, and are arranged in a manner such that one of these first fabrics acts as a press fabric in the first nip, and the other fabric acts as a press fabric both in the first nip and in the second nip.

According to FIG. 3 of Finnish Application No. 823187, the press section is provided with a front frame, a rear frame, and with an intermediate frame between the same, these frame parts being interconnected by means of horizontal beams situated both at the service side and at the operating side of the paper machine. These beams interconnect the vertical frame parts above the press rolls. Under these circumstances, the concerned frame part is permanently fully closed from above, which makes the replacement of the press rolls and of the various fabrics more difficult and slow.

In connection with the prior art frame parts of these press sections, difficulties and relatively long standstills have occurred in relation to the replacement both of the press fabrics and of the press rolls. These problems have been increased with an increase in the widths of the paper machine, in particular because the press rolls have become much longer and heavier. These problems have also been increased by the fact that press fabrics which are made of plastic material and which are rigid in the transverse direction thereof, has started being used ever increasingly. These press fabrics cannot be jammed into a bundle because of their rigidity.

SUMMARY OF THE INVENTION

Accordingly, it is an object of the present invention to eliminate the difficulties and problems noted above with respect to the prior art structures.

It is also an object of the present invention to further develop the frame constructions of press sections provided with separate nips, so that the replacement of the press rolls and of the various fabrics can be made considerably easier and faster.

It is an additional object of the present invention to provide a frame construction in a press section of a paper machine provided with separate nips that is essentially shorter than prior art frame constructions. By shortening the frame construction, investment costs both in the paper machine and in the paper mill can also be decisively reduced in other respects, because a paper machine hall of shorter length in the machine direction is required.

These and other objects are attained by the present invention which is directed to a frame structure for a press section of a paper machine having, in a running direction of a web from which water is removed, at least two separate nips substantially dewatering the web and being formed between opposite press elements through which the web runs supported by a fabric. The structure comprises a front frame and a rear frame separate from one another and defining a space therebetween which is substantially open at a top thereof and situated for use in replacement of fabric and press elements. An upper press element of one of the nips can be mounted at a rear part of the front frame, while an upper press element of another nip can be mounted at a front part of the rear frame. The press elements are preferably press rolls.

Accordingly, in view of achieving the objects noted above and those which will become apparent below, a frame construction or structure of a press section provided with separate nips in accordance with the present invention, is principally characterized by a front frame and a rear frame separate from one another, between which a space is provided which is substantially open at the top. This free space is arranged so as to be utilized in replacement of both of the upper press and/or transfer fabrics and of the press rolls. At least an upper roll or corresponding press element of a first or second nip in the press section is attached in conjunction with a rear part of the front frame, and at least an upper roll or corresponding press element of a second or third press nip in the press section is fitted in connection with a front part of the rear frame.

Due to the present invention, faster replacement of the rolls in a press section and in particular of the press and transfer fabrics, is quite significant in view of the production output of the paper machine, because the durations of standstills resulting from the replacements of press rolls and fabrics can be made essentially shorter. In particular, the replacements of press fabrics must be repeated at quite short intervals.

It is a further advantage of the invention that at the service side of the paper machine, an equally abundant space is not needed as when closed frame constructions of a press section are used, because the rolls, at least heavier rolls, can be lifted above the frame construction of the press section and, if necessary, be turned thereat to a position parallel to the machine direction. In the latter case, so-called center lifting of the rolls is preferably used.

BRIEF DESCRIPTION OF THE DRAWINGS

The present invention will now be described in greater detail below, with reference to exemplary embodiments thereof illustrated in the accompanying drawings, and to which the present invention is not intended to be strictly confined. In the drawings.

DESCRIPTION OF THE PREFERRED EMBODIMENTS

Figure 1:
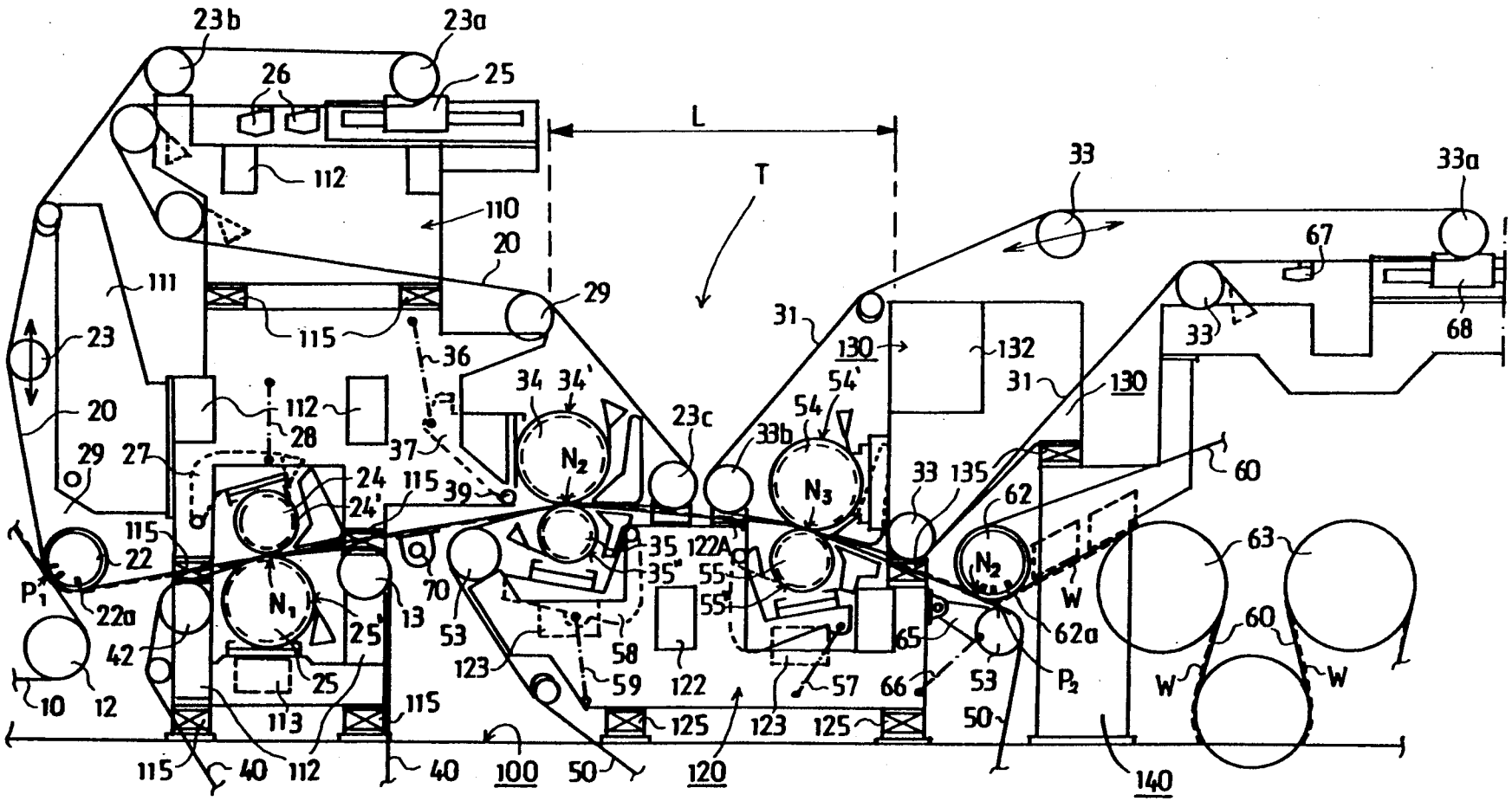
FIG. 1 is a schematic side view of a first embodiment of the present invention.
Figure 2:
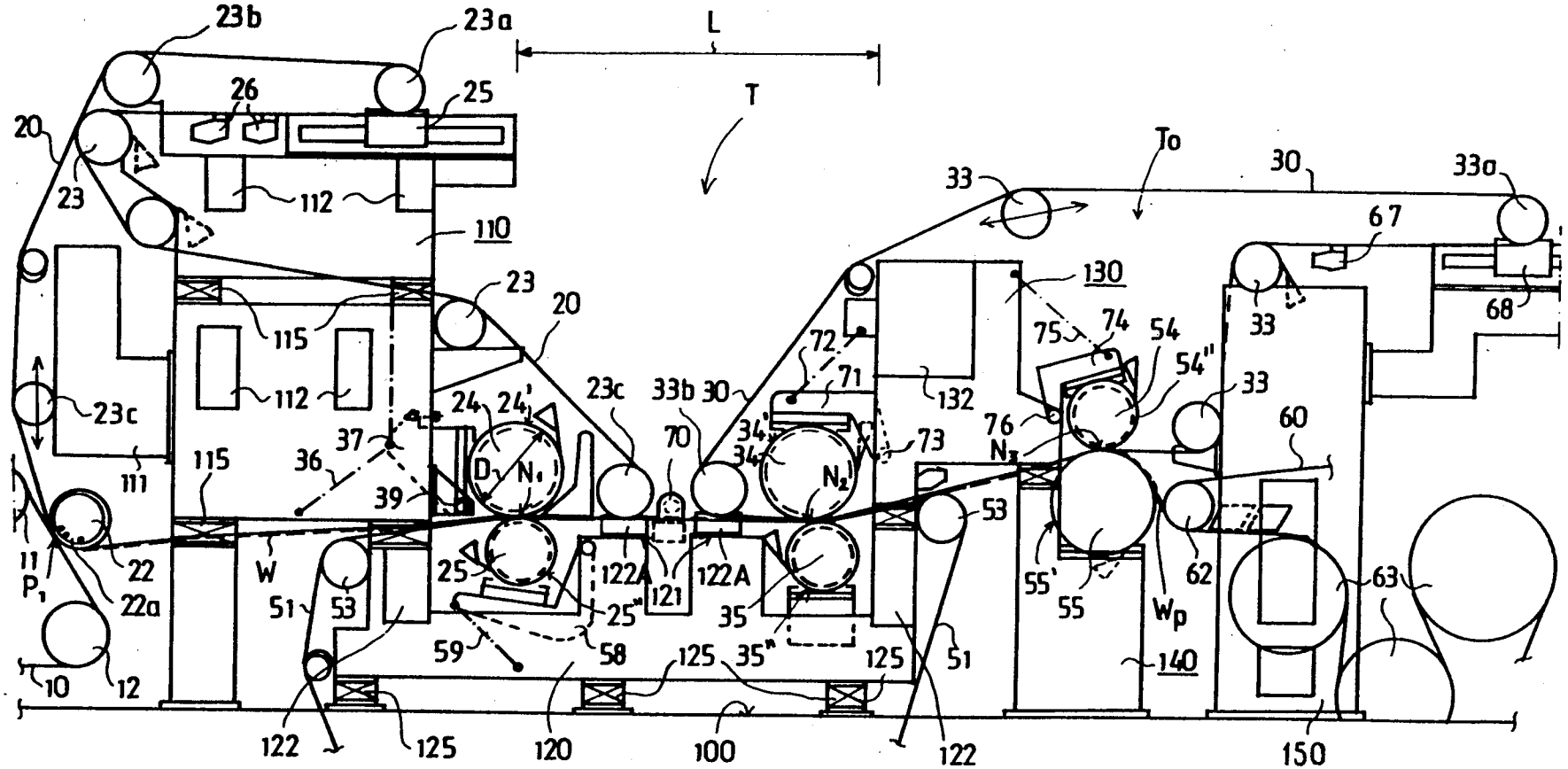
FIG. 2 is a schematic side view of a second embodiment of the present invention.

According to possible exemplary embodiments of the present invention shown in FIGS. 1 and 2, a web W is formed on a wire 10 which is either a fourdrinier wire or the carrying wire in a twin-wire former. On a downwardly slanting run of the wire 10 between a suction roll 11 and a wire drive roll 12, the web W is transferred at detaching line $P_1$ on a suction zone 22*a* of a pick-roll 22 and onto a first upper fabric 20 which is both a press fabric that receives water and a pick-up fabric.

The fabric 20 carries the web W on a lower face thereof into a first press nip $N_1$ which is formed between two press rolls 24 and 25. The nip $N_1$ is provided with two press fabrics, i.e. the upper fabric 20 and a first lower fabric 40 which is a press fabric that received water. According to FIG. 1, the upper press roll 24 in the nip $N_1$ is provided with a hollow face 24' that receives water. The lower roll 25 in the nip $N_1$ is a hollow-faced 25' press roll with a diameter preferably slightly larger than the diameter of the upper roll 24. One of the press rolls 24 and 25 can also be a press-suction roll. One or both of the press rolls 24;25 is/are provided with a drive. In the first nip $N_1$, the dewatering takes place through both faces of the web W both into the upper fabric 20 and into the lower fabric 40.

After the first nip $N_1$, in the run of the web W, there is a second separate nip $N_2$ which is formed between two press rolls 34 and 35. According to FIG. 1, the first upper fabric 20 carries the web W on a lower face into the second nip $N_2$. The web W following along with the upper fabric 20 and not with the lower fabric 40 after the first nip $N_1$, is ensured by means of well-known arrangements. According to FIG. 1, in the second nip $N_2$ the lower fabric is a particular transfer fabric 50 which, compared to the press fabrics proper, is relatively or fully impervious and which fully or substantially does not receive water. Thus, in FIG. 1, the dewatering taking place in the second nip $N_2$ is primarily towards the first fabric 20, i.e. upwardly. Due to the surface properties (smoothness and adhesion) of the transfer fabric 50, and due to the arrangements which will be further explained below, the web W according to FIG. 1 follows along with the transfer fabric 50 which carries the web W into a third, separate dewatering press nip $N_3$ in the press section.

According to FIG. 1, a second upper fabric 31 is a press felt which receives water and which runs through the nip $N_3$. The upper fabric 31 is guided by guide rolls 33, 33*a* and 33*b* and reconditioned by devices 67.

According to FIG. 2, the web W is arranged to follow along with a first lower fabric 51 after the first nip $N_1$, which carries the web W on its upper face into the second separate nip $N_2$. This nip $N_2$ is formed between two press rolls 34 and 35, with the roll 35 being provided with a hollow face 35'', and the roll 34 being provided with a hollow face 34', In FIG. 2, the second nip $N_2$ is also provided with two fabrics, with a lower fabric being the first lower fabric 51 which is a press fabric that receives water and is pervious to water, e.g. an ordinary press felt. According to FIG. 2, the upper fabric in the second nip $N_2$ is a press felt 30. In FIG. 2 the lower roll 25 is also hollow faced at 25''.

According to FIG. 2, the dewatering takes place both upwardly and downwardly in the nip $N_2$. After the nip $N_2$, following of the web W along with the upper press felt 30 is ensured, e.g., by means of the felt angles or by means of a suction device. The web W is passed into a third nip $N_3$ in the press section along with the upper press felt 30.

According to FIG. 2, the third nip $N_3$ which is a separate nip and the last substantially dewatering nip in the press section, is formed between two press rolls 54 and 55, one of which is provided with a hollow face 54'' and the other one with a smooth face 55'. According to FIG. 1, in the third nip $N_3$ the lower fabric is a transfer fabric 50 and the upper fabric is a press fabric 31 that receives water. According to FIG. 2, the upper fabric is a press felt 30 and after the nip $N_3$, the web W follows along with the smooth-faced 55' lower roll 55, from which the web W is detached and transferred as an open draw $W_p$ onto the drying fabric 60 in a multi-cylinder dryer.

According to FIG. 1, the transfer fabric 50 carries the web W after the nip $N_3$ onto a transfer-suction roll 62 over whose suction zone 62*a* the drying wire 60 in the drying section of the paper machine is passed. The web W is transferred at the line $P_2$, by the effect of a suction zone 62*a*, from the transfer fabric 50 onto the drying wire 60 and onto whose face the web W is made to adhere. The drying wire 60 passes over a first drying cylinder 63 or a corresponding lead-cylinder in the drying section. The web W proceeds along its run being supported by the drying wire 60, as a so-called single-fabric draw, at least in the initial part of the drying section.

In FIGS. 1 and 2, the guide rolls of the first upper fabric 20 are denoted by reference numerals 23, 23*a*, 23*b* and conditioners by numeral 26. Correspondingly, in FIG. 1, and in the running direction of the web W, the first guide roll of the first lower fabric 40 is denoted by reference numeral 42, and the other guide rolls by reference numeral 13. The guide rolls of the second upper fabrics 30, 31 are denoted by reference numerals 33, 33*a*, 33*b*, while the guide rolls of the lower fabrics 50;51 are denoted by reference numeral 53.

According to FIGS. 1 and 2, a steam box 70 is fitted between the first $N_1$ and second $N_2$ nips, to operate against the web W, with steam being applied into the steam box 70. The functioning of the steam box 70 is known in a manner in and of itself, for intensifying the dewatering.

A frame construction in accordance with the present invention will be described below, which is synergic with the press concepts described above, and by which an easier and faster replacement of press fabrics and press rolls, as well as constructional advantages, is achieved. The frame construction in accordance with FIGS. 1 and 2 comprises a front frame 110 constructed as supported on foundations 100 of the paper machine hall, an intermediate frame 120, and rear frames 130 and 140. Moreover, in FIG. 2 there is a third rear frame part 150. At a front side of the front frame 110, there is a projection part 111 on which the guide roll 23 of the first fabric 20 and the pick-up-suction roll 22 are supported, the suction roll 22 by means of loading arms 29. The front frame 110 is provided with cantilevered transverse beams 112. Moreover, the service-side side frame of the front frame 110 is provided with openable intermediate pieces 115.

The intermediate frame 120 comprises cantilevered transverse beams 122. The guide roll **23*c* of the first fabric 20 and the guide roll 33*b* of the third fabric 30;31 are mounted on an upper side 121 of the intermediate frame 120 through supports 122A. The side frames of the intermediate frame 120 at the servicing side are provided with openable intermediate pieces 125**.

The rear frame 130 comprises cantilevered transverse beams 132 as well as, in the side frames at the servicing side, openable intermediate pieces 135.

It is characteristic of the frame parts in accordance with the present invention that between the front frame 110 and the rear frame 130, i.e. above the relatively low intermediate frame 120, there is an open space T. In other words, the front frame 110 and the rear frame 130 are not interconnected at the upper parts of the frame, at least not by means of strong frame beams proper. The open space T can be utilized in the present invention in a number of ways, as will be described in greater detail below.

As car be noted immediately from FIGS. 1 and 2, there are nips at both sides of the open space T, namely the second and third nip $N_2$ and $N_3$ in FIG. 1, as well as the first and the second nips $N_1$ and $N_2$ in FIG. 2. Moreover, there is also an open space $T_0$ in FIG. 2 between the former rear frame 130 and the latter rear frame 140 above the nip $N_3$. The rolls of the third nip $N_3$ can be replaced through this space $T_0$.

According to FIG. 1, the press rolls 24 and 25 in the first nip $N_1$ are mounted inside the front frame 110. The upper press roll 24 is attached to an articulated intermediate part 27 which can be displaced by means of power units 28 for the purpose of opening and closing and loading of the nip $N_1$. According to FIG. 1, the upper roll 34 in the second nip $N_2$ is supported on an articulated intermediate part 37 which can be pivoted by means of power units 36 so as to facilitate the replacement of the felt 20 or, if required, so as to open the nip $N_2$. The loading of the nip $N_2$ takes place primarily by means of power units 59 of the lower roll 35.

According to FIG. 1, the upper roll 34 in the second nip $N_2$ is mounted on the rear side of the front frame 110. The lower roll 35 of the second nip $N_2$ is supported on intermediate parts 58, which can be displaced by means of the power units 59 so as to open and to load the nip $N_2$. Furthermore, according to FIG. 1, the upper roll 54 of the third nip $N_3$ is mounted in stationary bearing supports placed on the front side of the rear frame 130. On the other hand, the lower roll 55 (having hollow face 55'') of the third nip $N_3$ is supported on intermediate parts 56 which can be pivoted around an articulated joint by means of power units 57 in connection with the intermediate frame 120, so as to load and to open the nip $N_3$. In FIG. 1, the transfer-suction roll 62 is mounted on the rear frame 140 by means of stationary bearing supports, and the guide roll 53 for the fabric 50 placed underneath the roll 62, is attached to articulated intermediate part 65 which can be pivoted by means of power units 66 in connection with the intermediate frame 120.

According to FIG. 2, the first nip $N_1$ is situated in the same location as the second nip $N_2$ in FIG. 1. According to FIG. 2, the upper roll 24 of the first nip $N_1$ is mounted on intermediate parts 37 which are connected to the front side of the front frame 110 by means of articulated joints 39, being pivoted by means of power units 36. In FIG. 2, the intermediate frame 120 is, in the machine direction, longer than in FIG. 1. According to FIG. 2, the upper roll 34 of the second nip $N_2$ is mounted on intermediate parts 71 which are loaded by power units 72. The intermediate parts 71 are mounted at the proximity of the front side of the rear frame 130 by means of articulated joint 73 placed thereat. In other words, the first nip $N_1$ is situated in connection with the rear side of the front frame 110, and the second nip $N_2$ is fitted in connection with the front side of the rear frame 130, either stationarily or through intermediate parts 37, 71 which are attached to the front frame 110 and/or to the rear frame 130 by means of articulated joints 39, 73.

According to FIG. 2, the third nip $N_3$ is placed above the rear frame 140. The lower roll 55 of the third nip $N_3$ is mounted on the rear frame 140 and the upper roll 54 is mounted on intermediate parts 74 which can be pivoted by means of power units 75 around the articulated joint 76. This joint 76 is placed in connection with the rear side of the rear frame 130. Finally, the frame part includes a third rear frame 150, with the transfer roll 62 and the guide roll **33*c* for the fabric 30** being permanently or stationarily mounted to a front side thereof.

Replacement of different fabrics in connection with the frame structure in accordance with the present invention, will be described below with reference to FIG. 3.

When the upper fabric 20 is being replaced, the old fabric is removed and the intermediate pieces 115 are opened so that free intermediate spaces 115A are opened at the area of the service side of the front frame 110. The suction roll 22 is displaced to the open position 22A. The press rolls placed inside the fabric loop 20 are shifted to positions 24A and 34A that open the nips $N_1$ and $N_2$ by pivoting the intermediate parts 27;37 by means of the power units 28;36. In order that all the rolls to be placed inside the loop of the fabric 20 can be brought sufficiently close to one another, the upper guide roll **23*a* which is supported on the tensioning means 25 is displaced to its parking site at position 23A. By the same token, the other guide roll 23*b* situated above the front frame 110 is displaced to a parking site in position 23B, supported on the projection part 111 of the frame. The role 23*c* is displaced along route C to the position 23C**.

Figure 3:
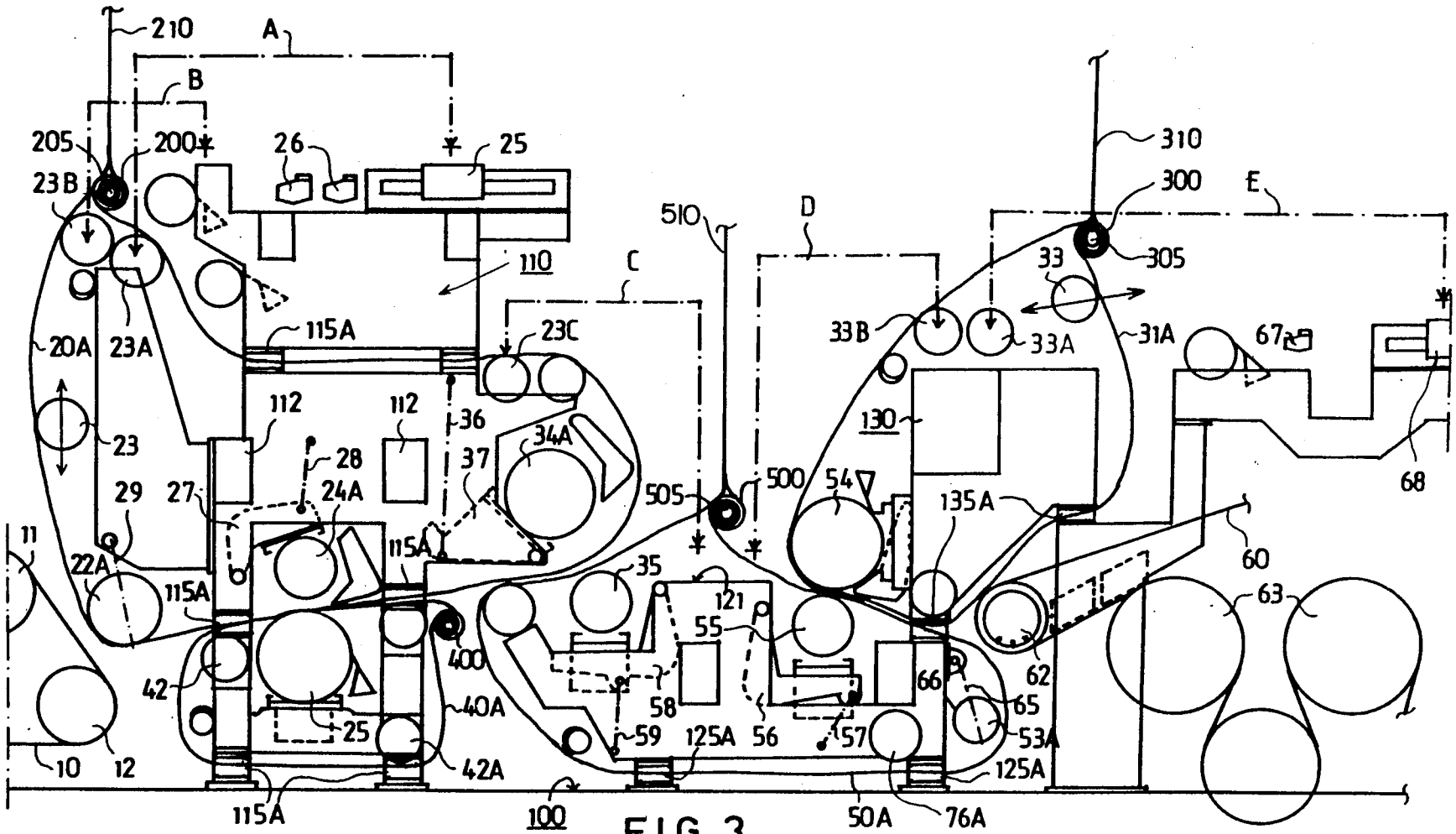
FIG. 3 illustrates replacement of fabrics as applied to the press section of FIG. 1.

When the pick-up point $P_1$ and the nips $N_1$ and $N_2$ are opened, and when the rolls **23*a*, 23*b* and 23*c* are in their inner positions 23A, 23B and 23C while the intermediate pieces 115 are open, the fabric loop is passed through the intermediate spaces 115A at the side frame at the servicing side so that it forms a loop 20A as shown in FIG. 3, having been opened from the fabric roll 200 which is placed on the replacement pole 205. The replacement pole 205 is supported from both of its ends by means of lifting wires 210, which are attached to the traverse crane (not illustrated) in the paper machine hall. The loop 20A is then spread out by unwinding the fabric 20 from the twofold roll 200 to its full width and length by alternatingly displacing the guide rolls 23A, 23B and 23C to their normal operating positions along the route A, B and C. After the fabric 20 has been spread out and tensioned, the pick-up point $P_1$ is closed along with the nips $N_1$ and $N_2$ and the intermediate pieces 115, and the fabric 20** are tightened.

When the first lower fabric 40 is being replaced, the guide roll located in the basement space is displaced to upper position 42A, intermediate pieces 115 are opened, and the fabric loop 40A is passed from the roll 400 around the beams 112, 113, the press roll 25 and the guide rolls 42 and 13, whereupon the intermediate pieces 115 are closed, the roll 42A is displaced into the basement space, and the fabric 40 is tensioned.

In connection with the second lower fabric 50, it is especially advantageously possible to utilize the constantly open space T placed between the front and rear frames 110 and 130. In order to open the space T completely, the foremost guide roll **23*c* of the fabric 20 is displaced along the route C to the parking site at position 23C in connection with the rear side of the front frame 110. Correspondingly, the foremost guide roll 33*b* of the second upper fabric 31 is displaced along the route D to the parking site 33B in connection with the upper part of the rear frame 130. When the nips $N_2$ and $N_3$ and the intermediate pieces 125 are then in the open position, and when the roll 53 is in the inner position 53A having been pivoted by means of the power unit 66, the fabric loop 50A is passed around the press and guide rolls to be placed inside the loop 50A. The guide roll 76 or guide rolls situated in the basement space is/are displaced to the upper position 76A above the intermediate spaces 125A, so that the roll becomes placed inside the fabric loop 50A**.

The roll 50 of the fabric 50 is supported on the replacement pole 505. The replacement pole 505 is supported at both ends by means of lifting wires 510 which are supported by the traverse crane operating at a ceiling of the paper machine hall. At the same time as the fabric loop 50A is widened by unwinding from the roll 500, the guide roll or guide rolls 76A are displaced to the lower position and the fabric 50A is spread out to its full width and length, whereupon the intermediate pieces 125 and the nips $N_2$ and $N_3$ are closed, the guide roll 53A is shifted to its normal position, and the fabric 50 is tensioned.

The second upper fabric 31 is replaced so that the old fabric is removed, the intermediate pieces 135 are opened, and the foremost guide roll **33*b* is shifted along the route D to its parking site at the position 33B. Correspondingly, the rearmost guide roll 33*a* is shifted along route E to its parking site at the side of the roll 33B to the position 33A. Afterwards, the fabric roll 300 supported by the replacement pole 305 and by the lifting wire 310, and having been spread out to make a loop 31A, is passed around the press roll 54 and the guide rolls 33, 33A and 33B through the intermediate spaces 135A. The rolls 33A and 33B are then shifted along the routes D and E to their operating positions while at the same time unwinding the fabric 31A from the roll 300 and spreading it, whereupon the nip $N_3$ is closed and the fabric 31 is tensioned by means of the tensioning devices 68 of the guide roll 33*a***.

Within the scope of the present invention, it is also possible to use seamable press and transfer fabrics. In such a case, the frame parts do not require openable intermediate pieces 115, 125 or 135.

Figure 4:
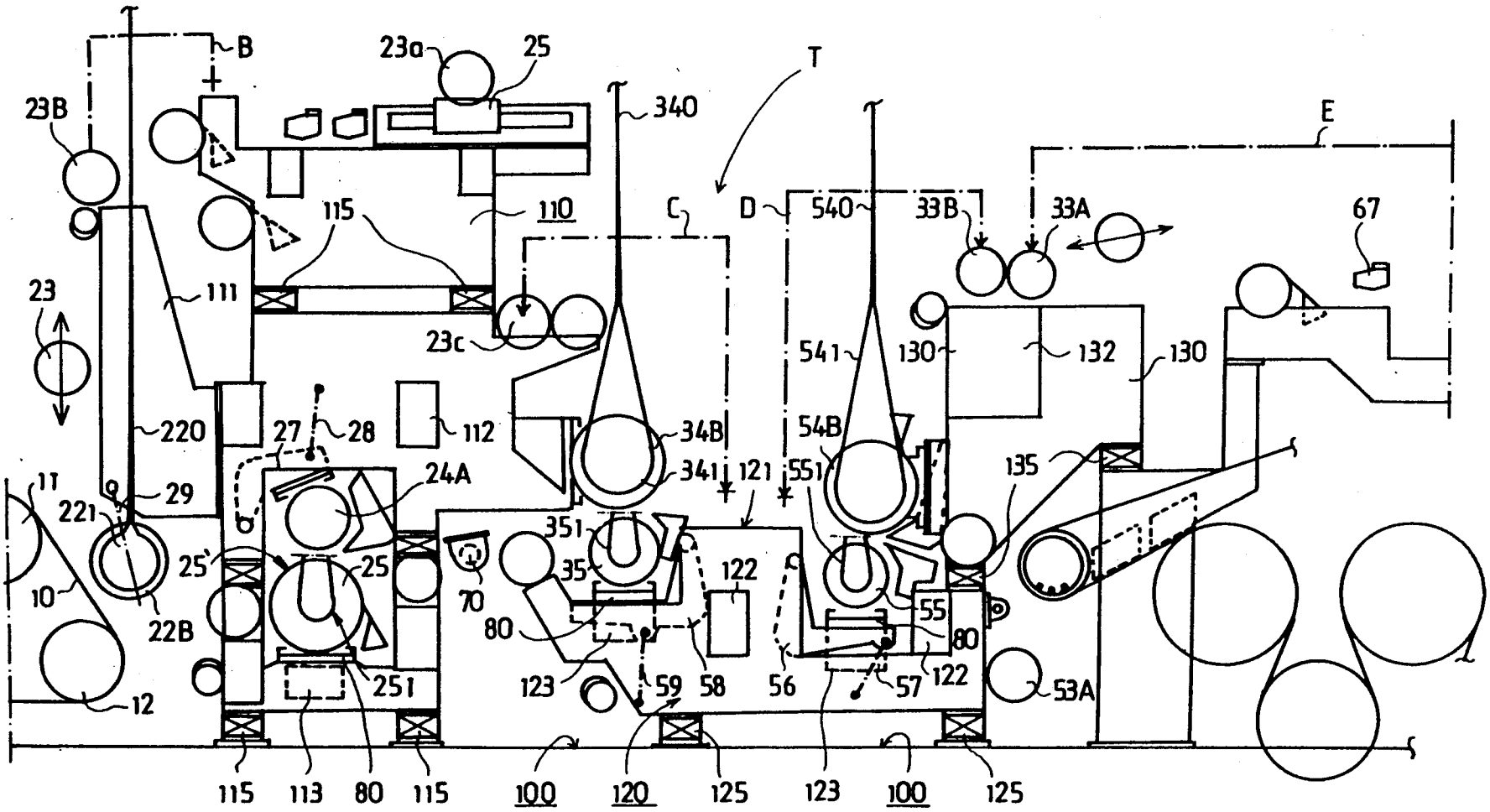
FIG. 4 illustrates replacement of rolls as applied to the press section of FIG. 1.

The replacement of the pick-up roll 22 and of the various press rolls will be described below with reference to FIG. 4. When the pick-up roll 22 is being replaced, it is in the position 22B and the fabric 20 has been removed. The loops 221 of the pair of lifting wires 220 are attached to the axle journals of the pick-up roll 22B. The lifting wires 220 are attached to the traverse crane of the paper machine hall.

The lower roll 25 of the first nip $N_1$ is replaced so that it is detached from its bearing supports and suspended by means of its axle journals on wire loops 251. The roll 25 is then lowered onto a roller conveyor 80 or equivalent transfer means which is supported on the transverse beam 113, and by means of which the roll 25 is pulled out to the service side from inside the frame part of the paper machine. The upper roll 24A of the first nip $N_1$ is replaced in a corresponding manner or in the traditional manner by slipping it by means of three hooks.

The upper roll 34B of the second nip is replaced by utilizing the open space T between the frame parts 110 and 130. After the fabric 20 has been removed, the roll 34B is suspended on the wire 340 loops 341, detached from its bearing supports, and lifted by means of the traverse crane above the press section while making use of the space T.

The lower roll 35 of the second nip $N_2$ is replaced either by pulling out by means of the roller conveyor 80 resting on the beam 123, or by making use of the space T after the roll 34B has been removed, by lifting the roll 35 suspended on the loops 351 of the lifting wires by both of its axle journals.

The upper roll **54*b* of the third nip is replaced by lifting it by means of the lifting loops 541 of the lifting wires 540 while making use of the space T. The lower roll 55 of the third nip $N_3$ is replaced either by lifting by means of the lifting-wire loops 551, or by pulling it out longitudinally on the roller conveyor 80 resting on the beam 123, aided and supported by the lifting wires 551**.

Instead of the supporting by the axle journals, which was described above, the press rolls, at least the heaviest rolls, can also be lifted as so-called center lifting, in which the lifting takes place by means of one lifting wire which is placed at the vertical plane of the center of gravity of the roll to be lifted, the lifting loops arranged in the form of a downwardly open V being provided around the roll at both sides of this plane. The center lifting provides the advantage that the roll can be turned more freely above the frame construction of the press section in the machine direction, whereby the displacement of the roll becomes easier. The new rolls can be brought to their proper location correspondingly.

The new rolls are inserted in their location by performing the operations described above in a reversed sequence. The roll 25 must be brought to its location by pushing it longitudinally into the frame construction on support of the roller conveyor 80 while one of its ends is supported by a wire loop 251, at least at the initial stage of the lifting. The rolls 35 and 55 can be brought either through the open space T or by pushing in on the roller conveyor 80.

In FIGS. 1 and 2, the length of the open space T in the machine direction is denoted by L. The length L must be dimensioned optimally, e.g. so that the range of the length L is related to the (maximum) diameter D of the press rolls 24, 34 as follows: L=kD, wherein k=about 2 to 5, preferably k=about 3 to 4.

The present invention can also be applied to press sections provided with an extended nip or provided with only two separate nips. In such a case, one of the nips, preferably the latter nip, may be a so-called extended nip. In its details, the press section concept concerned may be, e.g., similar to that described in the Valmet Finnish Patent Applications Nos. 842114 or 852115.

In principle, a two-nip solution in accordance with the present invention may be, e.g., similar to that shown in FIG. 1 with the first nip $N_1$ omitted and, e.g., with the third nip replaced by a corresponding extended nip or alternatively, similar to that shown in FIG. 1, so that the third nip and the latter rear frame 140 are omitted and the second nip $N_2$ or both nips $N_1$ and $N_2$ are replaced by corresponding extended nips. Also, the runs and the arrangement of the fabrics and the quality of the various fabrics may differ from above.

When the present invention is applied, the draw of the web W does not necessarily have to be fully closed, even though a closed draw is advantageous. In other words, the guide rolls and press rolls or corresponding press elements that are placed inside the loops of the upper fabrics 20, 30, 31 and lower fabric 51 or lower fabric 40, 50, may be fitted in a manner in connection with the front frame 110, the intermediate frame 120, and the rear frames 130, 140 and 150, so that a substantially closed draw is obtained for the web W from the pick-up point $P_1$ to the drying section $P_2$, $W_p$ of the paper machine. The nips $N_1$, $N_2$ and $N_3$ may also have larger mutual differences in height than what is shown in FIGS. 1 and 2.

The same reference numerals denote the same or similar components throughout the various figures.

Various details of the present invention may vary within the scope of the inventive concepts set forth above which have been given for exemplary purposes only. In other words, the preceding description of the present invention is merely exemplary, and is not intended to limit the scope thereof in any way.

I claim:

1. Frame structure in a press section of a paper machine having, in a running direction of a web from which water is removed, at least two separate press nips formed by respective separate pairs of press rolls substantially dewatering the web and being formed between opposite press elements through which the web runs supported by a fabric, comprising a front frame and a rear frame separate from and unlinked to one another and defining a permanently open space therebetween above said two separate press nips which is situated for use in replacement of fabric and press elements, said front frame having a rear part at which an upper press element comprising one of said press rolls of one of the nips is mounted, and said rear frame having a front part at which an upper press element comprising one of said press rolls of another nip is mounted, an intermediate frame situated between said front and rear frame and on which both a first lower roll of one of a first pair of press rolls forming a first press nip and a second lower roll of a second pair of press rolls forming a second press nip are supported; and a plurality of intermediate parts disposed between said intermediate frame and said first and second lower rolls, said plurality of intermediate parts being movable so as to open and to load one of said first press nip and said second press nip.

2. The combination of claim 1, wherein said intermediate frame is substantially lower than said front and rear frames.

3. The combination of claim 1, wherein another press nip is located upstream in the running direction of the first press nip, and is situated inside said front frame which comprises a pair of press rolls which are fitted upon said front frame to be replaceable by transverse pulling.

4. The combination of claim 1, wherein in the running direction, the first nip is situated at said rear part of said front frame, and the second nip is situated at said front part of said rear frame.

5. The combination of claim 4, wherein said upper press rolls of the first and second nips are stationarily mounted on said front and rear frames respectively.

6. The combination of claim 4, additionally comprising intermediate members attached to said front and rear frames by articulated joints and on which the upper press rolls of the first and second nips are mounted.

7. The combination of claim 6, additionally comprising a second rear frame on which pressing elements forming a third nip are supported.

8. The combination of claim 7, additionally comprising a third rear frame on which a transfer roll and a guide roll for a fabric passing through the third nip are mounted.

9. The combination of claim 1, where said intermediate frame comprises an upper side on which guide rolls for fabric passing through the nips are detachably mounted, said front frame comprises a parking site for one of the guide rolls, and said rear frame comprises a parking site for another guide roll, with the guide rolls being displaceable to said respective parking sites so that press fabric or elements can be replaced.

10. The combination of claim 9, wherein said front frame comprises two additional parking sites for two additional guide rolls and said rear frame comprises an additional parking site for a further guide roll.

11. The combination of claim 9, wherein those of said press rolls forming upper pressing elements of the two nips are detachably mounted and displaceable through said space between said front and rear frames and thereabove, by lifting of axle journals thereof or by central lifting after the guide rolls have been displaced to said parking sites.

12. The combination of claim 1, wherein a pick-up roll and at least an upper pressing roll of the first nip in the running direction are mounted on said front frame with a first upper fabric passing thereabout, guide rolls and at least an upper pressing roll of the second nip in the running direction are mounted on said rear frame with a second upper fabric passing thereabout which is either a water receiving press fabric or a substantially non-water receiving transfer fabric, with at least one lower fabric which is either a water-receiving press fabric or a substantially non-water receiving transfer fabric running through said first and second nips.

13. The combination of claim 1, wherein said frames are arranged such that the press rolls and fabric supported thereon pass the web through the press section as a substantially closed draw from a pick-up point to a drying section of the paper machine.

14. The combination of claim 1, wherein length L of said space in the running direction=kD where D=maximum diameter of one of the press rolls and k=about 2 to 5.

15. The combination of claim 14, wherein k=about 3 to 4.

16. The frame structure of claim 1, further comprising another plurality of intermediate parts, said another plurality of intermediate parts functioning to open and load the other of said first nip and said second nip.

17. Frame structure in a press section of a paper machine having, in a running direction of a web from which water is removed, at least two separate press nips formed by respective separate pairs of press rolls substantially dewatering the web and being formed between opposite press elements through which the web runs supported by a fabric, comprising a front frame and a rear frame separate from and unlinked to one another and defining a permanently open space therebetween above said two separate press nips which is situated for use in replacement of fabric and press elements, said front frame having a rear part at which an upper press element comprising one of said press rolls of one of the nips can be mounted, and said rear frame having a front part at which an upper press element comprising one of said press rolls of another nip can be mounted, an intermediate frame situated between said front and rear frames and comprising side frames integral thereto and located at a servicing side of said intermediate frame, and a plurality of openable intermediate pieces integrally connected to said side frames, said openable intermediate pieces being structured and arranged to allow replacement of said fabric through said permanently open space.

* * * * *